US009373317B2

(12) United States Patent
Streitenberger et al.

(10) Patent No.: US 9,373,317 B2
(45) Date of Patent: Jun. 21, 2016

(54) HEADSET AND HEADPHONE

(75) Inventors: Martin Streitenberger, Hannover (DE); Hatem Foudhaili, Hannover (DE); André Grandt, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 178 days.

(21) Appl. No.: 13/982,891

(22) PCT Filed: Feb. 1, 2012

(86) PCT No.: PCT/EP2012/051622

§ 371 (c)(1),
(2), (4) Date: Aug. 19, 2013

(87) PCT Pub. No.: WO2012/104329

PCT Pub. Date: Aug. 9, 2012

(65) Prior Publication Data

US 2013/0322642 A1 Dec. 5, 2013

(30) Foreign Application Priority Data

Feb. 1, 2011 (DE) ..... 10 2011 003 470

(51) Int. Cl.

| | |
|---|---|
| ***G10K 11/16*** | (2006.01) |
| ***G10K 11/178*** | (2006.01) |
| ***H04R 1/10*** | (2006.01) |
| *H04R 5/033* | (2006.01) |

(52) U.S. Cl.

CPC ..... *G10K 11/16* (2013.01); *G10K 11/178* (2013.01); *G10K 11/1788* (2013.01); *H04R 1/1083* (2013.01); *G10K 2210/1081* (2013.01); *H04R 5/033* (2013.01); *H04R 2460/01* (2013.01)

(58) Field of Classification Search

None

See application file for complete search history.

(56) References Cited

U.S. PATENT DOCUMENTS

| | | | | |
|---|---|---|---|---|
| 4,985,925 | A | 1/1991 | Langberg et al. | |
| 5,278,911 | A | 1/1994 | Bickerton | |
| 6,134,331 | A | 10/2000 | Baekgaard | |
| 6,807,280 | B1 | 10/2004 | Stroud et al. | |
| 7,006,638 | B1 * | 2/2006 | Baekgaard et al. | 381/67 |
| 2005/0053248 | A1 * | 3/2005 | Stroud | H03G 7/002 381/106 |
| 2011/0002474 | A1 * | 1/2011 | Fuller | G10K 11/1782 381/71.6 |

(Continued)

FOREIGN PATENT DOCUMENTS

| | | |
|---|---|---|
| DE | 694 16 442 | 10/1999 |
| EP | 0 803 860 | 10/1997 |
| WO | WO/93/26084 | 12/1993 |

OTHER PUBLICATIONS

International Search Report for Application No. PCT/EP2012/051622 dated May 22, 2012.

*Primary Examiner* — Andrew L Sniezek

(74) *Attorney, Agent, or Firm* — Frommer Lawrence & Haug LLP

(57) ABSTRACT

An earphone including at least one microphone, an analog pre-emphasis filter for pre-emphasis of the microphone signal, an AD-converter for digitizing the output signal of the pre-emphasis filter, an active noise compensation unit for performing active noise compensation based on the pre-emphasized and digitized output signal of the microphone and for outputting a counter sound signal, and a DA-converter for performing analog/digital conversion of the counter sound produced by the active noise compensation unit.

12 Claims, 7 Drawing Sheets

(56) References Cited

U.S. PATENT DOCUMENTS

2012/0057720 A1* 3/2012 Van Leest ..... G10K 11/1782 381/71.11

2012/0155667 A1* 6/2012 Nair ..... G10K 11/178 381/71.6

2013/0083939 A1* 4/2013 Fellers ..... G10K 11/178 381/71.11

* cited by examiner

HEADSET AND HEADPHONE

The present application claims priority from PCT Patent Application No. PCT/EP2012/051622 filed on Feb. 1, 2012, which claims priority from German Patent Application No. DE 10 2011 003 470.6 filed on Feb. 1, 2011, the disclosures of which are incorporated herein by reference in their entirety.

FIELD OF THE INVENTION

The present invention concerns a headset and an earphone.

It is noted that citation or identification of any document in this application is not an admission that such document is available as prior art to the present invention.

Headsets and earphones with an active noise compensation unit have long been known. The active noise compensation unit can be implemented both in analog and also digital fashion. The microphones of a headset or an earphone with active noise compensation detect audio signals of differing origin and at a different levels. The microphones detect for example interference sound from external sound sources, the sound reproduced by the reproduction transducer, the useful sound, and sound which is produced by virtue of movements between the headphone or the headset and the head of the user. Each of those sound events involves a specific spectrum with a specific level distribution.

As general state of the art attention is directed to DE 694 16 442 T2, U.S. Pat. Nos. 5,278,911 A, 6,134,331 A, 4,985,925 A and WO 93/26084 A1.

It is noted that in this disclosure and particularly in the claims and/or paragraphs, terms such as "comprises", "comprised", "comprising" and the like can have the meaning attributed to it in U.S. Patent law; e.g., they can mean "includes", "included", "including", and the like; and that terms such as "consisting essentially of" and "consists essentially of" have the meaning ascribed to them in U.S. patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of, any previously described product, method of making the product, or process of using the product.

SUMMARY OF THE INVENTION

It is thus desirable to provide an earphone or a headset having active noise compensation which can compensate in improved fashion for irregular level distribution of a noise spectrum.

Thus there is provided an earphone comprising at least one microphone, an analog pre-emphasis filter for pre-emphasis of the microphone signal, an AD-converter for digitizing the output signal of the pre-emphasis filter, an active noise compensation unit for performing active noise compensation based on the pre-emphasized and digitized output signal of the microphone and for outputting a counter sound signal, and a DA-converter for performing analog/digital conversion of the counter sound produced by the active noise compensation unit.

in a further aspect of the invention the filter parameters of the pre-emphasis filter for pre-emphasis of the microphone signal are adapted to the maximum expected level of the audio signals detected by the microphone.

Thus there is provided a headset comprising at least one microphone, an emphasis filter for pre-emphasis of a microphone signal, an AD-converter for digitizing the output signal of the emphasis filter, an active noise compensation unit for performing active noise compensation based on the pre-emphasized and digitized output signal of the microphone and for outputting a counter sound signal, and a DA-converter for performing analog/digital conversion of the counter sound produced by the active noise compensation unit.

The invention also concerns a method of controlling an earphone which has a microphone and an active noise compensation unit. The microphone signal is subjected to analog pre-emphasis by an analog pre-emphasis filter. The output signal of the pre-emphasis filter is digitized. Active noise compensation is performed based on the pre-emphasized and digitized output signal of the microphone and a counter sound is outputted. Digital/analog conversion of the counter sound produced by the active noise compensation unit is performed.

In an aspect of the present invention a digital pre-emphasis filter is provided between the active noise compensation unit and the DA-converter. As an alternative thereto an analog pre-emphasis filter can be provided downstream of the DA-converter.

The invention concerns the notion that, for each frequency, in a noise spectrum, there can be different levels which can differ greatly from each other. Thus the counter sound produced by the active noise compensation effect also involves an irregular level distribution.

To avoid that, an audio signal which has preferably been subjected to analog pre-emphasis is fed to digital signal processing of a digital active noise compensation to be able to increase a usable overall dynamic. The input audio signal is subjected to pre-emphasis processing (analog pre-emphasis). Analog/digital conversion is then effected. Optionally digital pre-emphasis can be effected after digital processing.

The analog and the digital pre-emphasis processing has the advantage that the usable dynamic of a digital/analog conversion and analog/digital conversion is enhanced and any artefacts which have possibly occurred in the audible region can be minimized.

The invention further concerns the notion of how digital noise compensation in an earphone or headset can be improved. If for example the power spectrum and/or the maximum levels in a noise-filled environment are known then the filters can be adapted suitably for pre-emphasis.

DETAILED DESCRIPTION OF EMBODIMENTS it is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
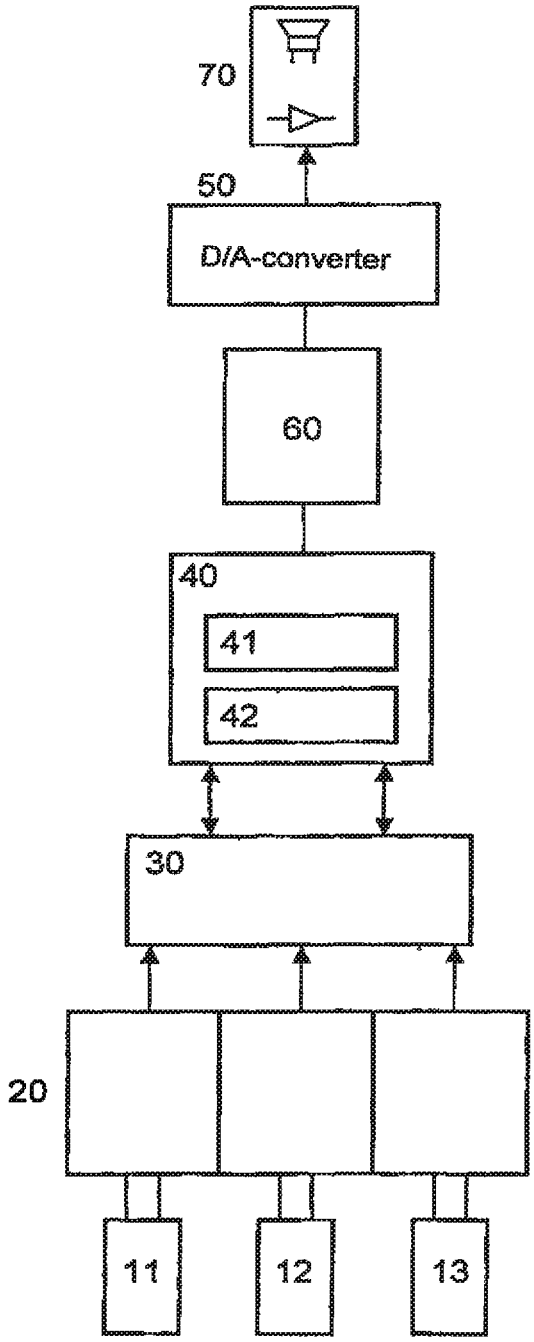
FIG. 1 shows a schematic block circuit diagram of an earphone or headset according to a first embodiment.

FIG. 1 shows a schematic block circuit diagram of an earphone or headset according to a first embodiment. The headset has an input unit 10 for example with an audio input 11, a first microphone 12 and a second microphone 13. The headset further has a pre-emphasis unit 20 which can receive the signals of the input unit and perform pre-emphasis processing (pre-emphasis). The output signal of the pre-emphasis unit 20 is passed to an AD-converter 30 which performs an analog/digital conversion operation. The audio signal of the AD-converter 30 is fed to an active noise compensation unit 40. The output signal of the active noise compensation unit 40 is fed to a digital pre-emphasis processing unit 60. The output signal of the pre-emphasis processing unit 60 is subjected to digital/analog conversion in a DA-converter 50. The output signal of the DA-converter 50 can be fed to an electroacoustic reproduction transducer 70 for output.

The noise compensation unit 40 can have one or more noise compensation filters 41, 42.

The pre-emphasis unit 20 can have a plurality of sub-units in order to feed each input signal of the input unit 10 to pre-emphasis processing. The pre-emphasis unit 20 performs analog pre-emphasis. After analog pre-emphasis the output signal of the pre-emphasis unit 20 is subjected to analog/digital conversion in the AD-converter.

The provision of a digital pre-emphasis unit 60 makes it possible to enhance the dynamics of the digital/analog converter 50 and in addition any artefacts which have possibly occurred can be reduced.

In a further embodiment of the invention based on the first embodiment, analog pre-emphasis can be effected.

Pre-emphasis according to the invention represents for example a lift of high frequencies and a lowering of low frequencies during recording or transmission of a signal. The lift or lowering of the high and low frequencies is then reversed upon reproduction or upon reception so that transmission or recording or detection, which is true to the original, can be implemented. In other words, pre-emphasis causes a lift in the high frequencies and a lowering of the low frequencies. Emphasis therefore represents an intentional change in the amplitude/frequency characteristic of an audio signal in order for example to suppress noise.

In an aspect of the present invention the digital pre-emphasis processing unit 60 can also be in the form of an analog pre-emphasis processing unit 60 and can be provided downstream instead of upstream of the DA-converter 50. In that way the analog pre-emphasis processing unit 60 would be connected directly to the electroacoustic reproduction transducer, that is to say the analog pre-emphasis processing unit 60 is provided between the DA-converter 50 and the electroacoustic reproduction transducer 70.

Figure 2:
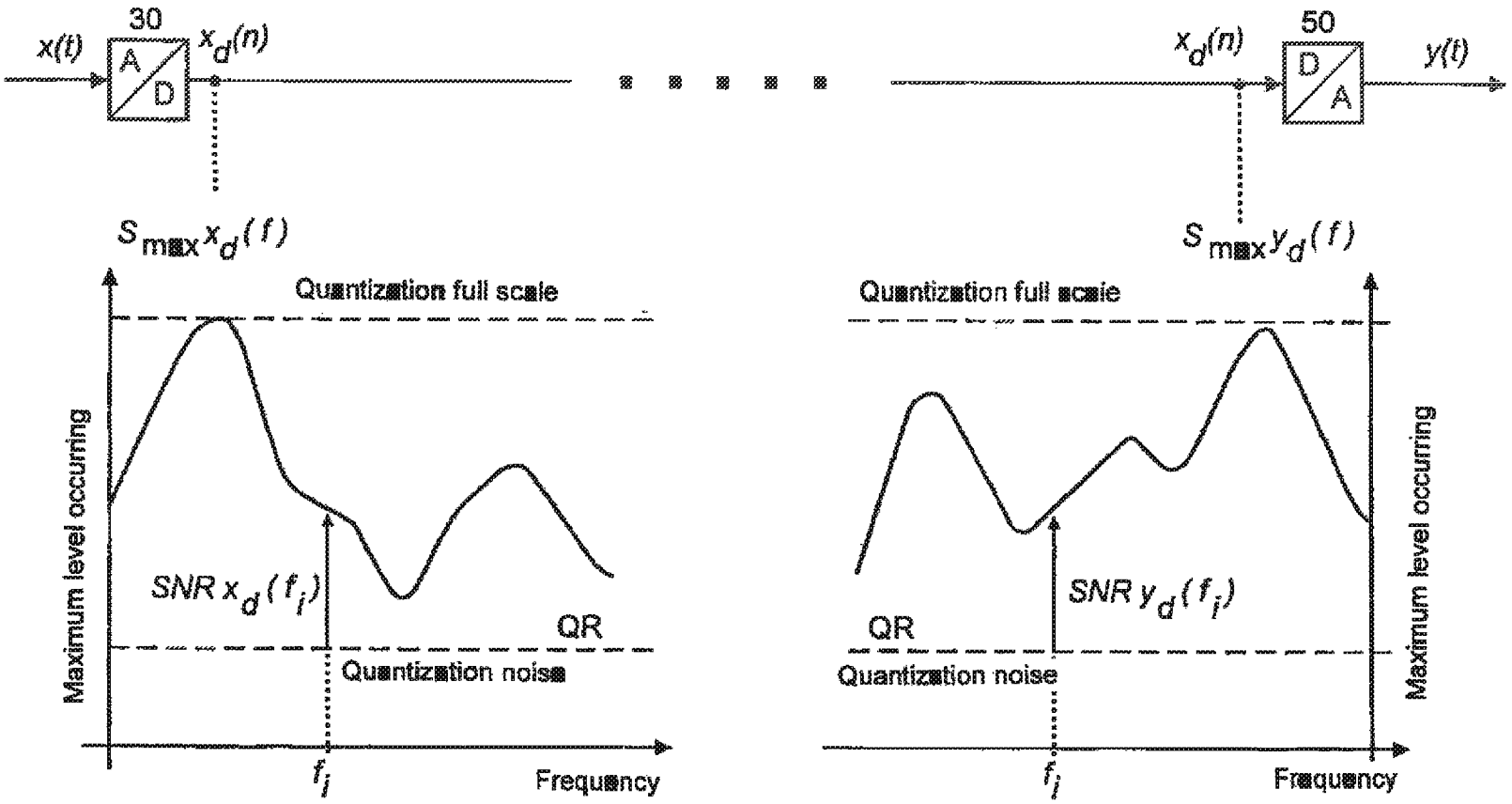
FIG. 2 shows a diagrammatic view of digital active noise compensation unit to describe the invention.

FIG. 2 shows a diagrammatic view of a digital active noise compensation system to describe the invention. The sound x (t) detected by the microphone is digitized by way of an AD-converter 30 ($x_d(n)$), subjected to active noise compensation (not shown in FIG. 2) and the counter sound $y_d$ (n) calculated by the active noise compensation means is converted into an analog signal y (t) again by a DA-converter 50. The maximum occurring level in respect of the input signal x (t) is shown at bottom left in FIG. 2 and the maximum occurring level of the counter sound $y_d$ is shown at the right. The quantization full scale is also shown. As can be seen at bottom left the spectrum of the input signal x is of a highly variable pattern in relation to frequency. The counter sound shown at bottom right in FIG. 2 also involves a highly variable pattern. The two lower views in FIG. 2 respectively show the quantization noise QR and the respective signal-noise ratio SNR $x_d$ ($f_i$) and SNR $y_d$ ($f_i$). The consequence of this is that the available dynamic ranges cannot be adequately utilized.

For optimum AD or DA-conversion preferably the highest level to be expected should occupy the full representation range (full scale) of the converter without the situation being able to involve overloading. That is necessary so that the greatest possible amplitude occurring can still be processed. On the other hand however the result of this is that the signal-noise ratio SNR at other frequencies is worse than at the maximum deflection.

if for example at a first frequency the maximum level is 40 dB less than the maximum possible level, that has the result that the signal-noise ratio SNR is 40 dB less than possible. Considered more precisely that can lead to a loss of between 6 and 7 bits of resolution. That is undesirable in particular in view of the fact that the resolution of a DA-converter and/or an AD-converter is typically between 12 and 24 bits. The reduced signal-noise ratio can lead to acoustic noise and can seriously disturb the function of active noise compensation.

Figure 3:
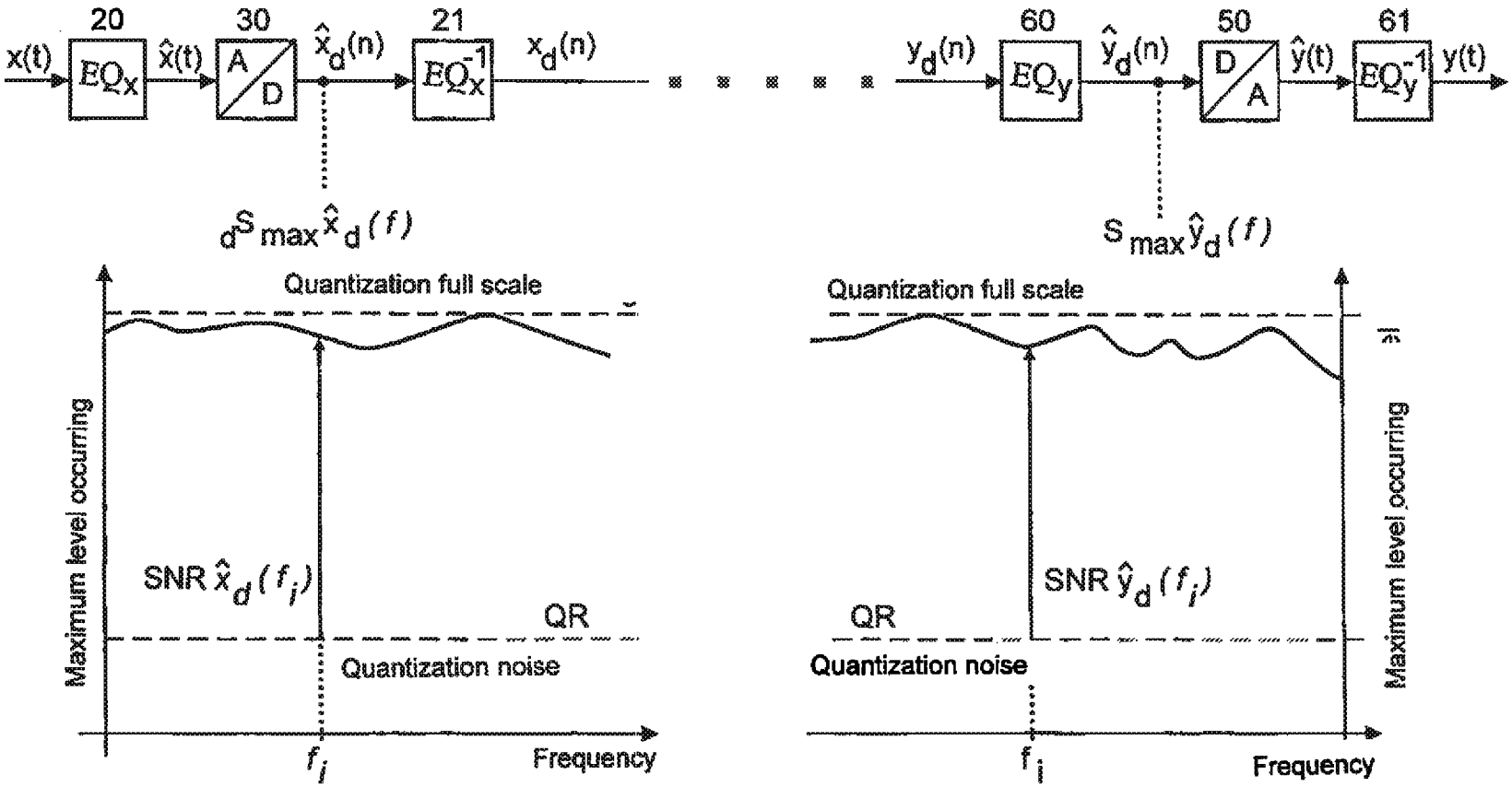
FIG. 3 shows a diagrammatic view of an active noise compensation system according to a second embodiment.

FIG. 3 shows a diagrammatic view of an active noise compensation system of a second embodiment. The system has an input signal x (t), a first analog filter (input pre-emphasis filter) 20, an AD-converter 30, a first digital filter (input de-emphasis filter) 21, an audio processing unit (not further shown), a second digital filter (output pre-emphasis filter) 60, a DA-converter 50 and a second analog filter (output pre-emphasis filter) 61. By virtue of the first analog filter 20, with a suitable configuration of the filter parameters, this involves compensation for the maximum possible level at the AD-converter.

Optionally the first and second digital filters 60 can be omitted.

The second digital filter 60 provides for a more uniform spectral distribution of the maximum levels at the D/A-converter. Thus the input and output signals to be processed by the AD- and DA-converters have a better signal-noise ratio.

If the audio signals to be expected are known in a noise-filled environment then the filter parameters can be appropriately configured.

The transmission of the entire signal path however changes due to the filters 20 and 60. To avoid a change in the reception and transmission paths, provided downstream of the AD-converter 30 is a first digital filter 21 and provided downstream of the DA-converter 50 is a second analog filter 61, wherein the first digital filter 21 represents a compensating filter (de-emphasis) with respect to the first analog filter 20 and the second analog filter 61 represents a compensating filter (de-emphasis) with respect to the second digital filter 60.

Therefore the signal-noise ratio can be improved with the active noise compensation system of the second embodiment, whereby less noise is to be heard.

Figure 4:
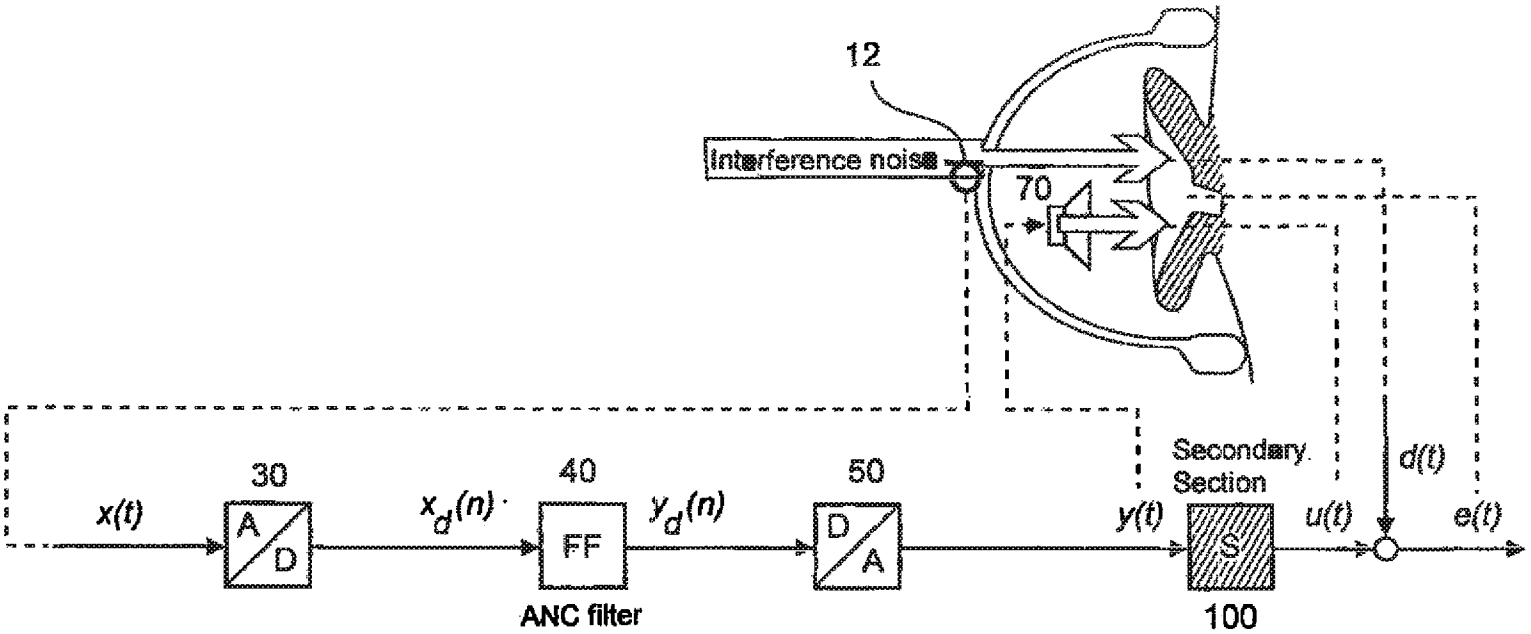
FIG. 4 shows a block circuit diagram of an earphone or headset according to a third embodiment.

FIG. 4 shows a block circuit diagram of an earphone or headset according to a third embodiment. The earphone or headset according to the third embodiment can be based on an earphone/headset according to the first or second embodiment. The earphone or headset has a microphone 12, an AD-converter 30, an active noise compensation filter 40, a DA-converter 50 and an electroacoustic reproduction transducer 70 as well as a secondary section 100. The active noise compensation in accordance with the third embodiment is preferably effected in accordance with the feed forward principle. An audio signal is detected by the microphone 12 and outputted as an output signal x (t). That output signal x (t) is subjected to AD-conversion in the AD-converter 30 and a digital output signal $x_d$ (n) is outputted to the filter 40. The output signal of the filter $y_d$(n) is outputted to the DA-converter 50 which in turn outputs an analog output signal y (t). That analog output signal y (t) is fed to the electroacoustic reproduction transducer 70.

The transmission section from the loudspeaker 70 and the acoustic section represents the so-called secondary section 100. The output signal y (t) of the DA-converter 50 is fed to the loudspeaker 70 which in turn delivers a counter sound u (t) which is superimposed on the interference sound d (t) to compensate for same. The result of that compensation represents the superimposition signal e (t).

Figure 5:
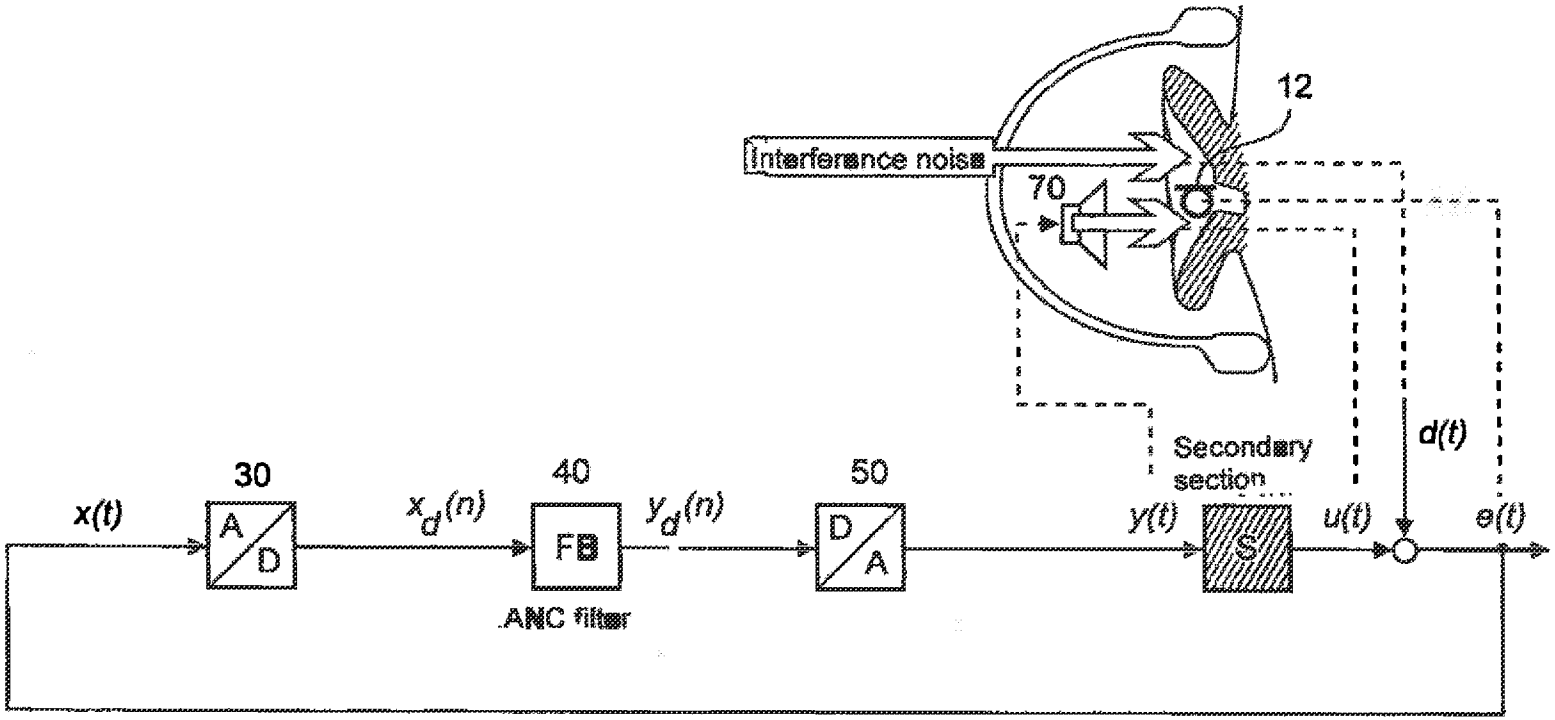
FIG. 5 shows a block circuit diagram of an earphone or headset according to a fourth embodiment.

FIG. 5 shows a block circuit diagram of an earphone or a headset according to a fourth embodiment. The earphone or the headset of the fourth embodiment substantially corresponds to the earphone or headset of the third embodiment in FIG. 4. The only difference is that the microphone 12 is provided in front of the loudspeaker and the filter 40 is in the form of a feedback filter, wherein a superimposition signal e (t) is fed back to the input of the AD-converter 30.

Figure 6:
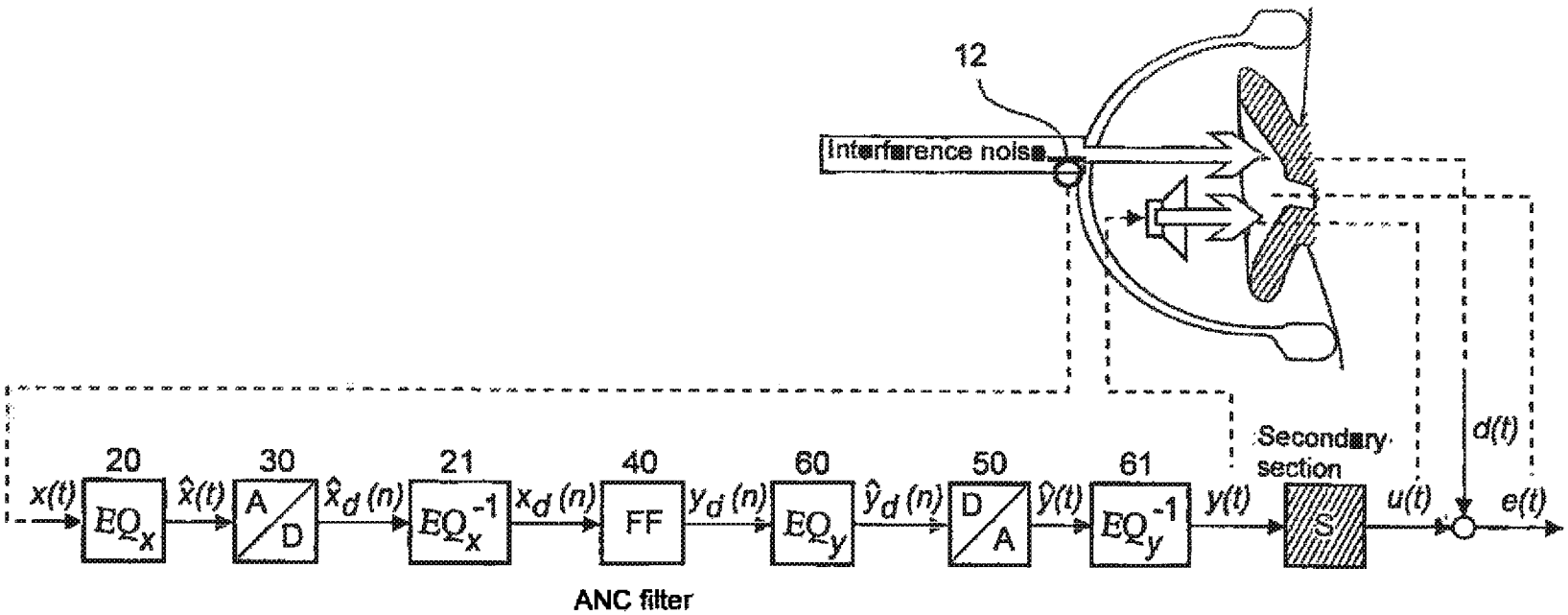
FIG. 6 shows a schematic block circuit diagram of an earphone or headset according to a fifth embodiment.

FIG. 6 shows a schematic block circuit diagram of an earphone or headset according to a fifth embodiment. The earphone or headset of the fifth embodiment is based on the earphone or headset of the third embodiment, wherein equalization and compensation filters 20, 21; 60, 61 are provided upstream and downstream of the AD-converter and the DA-converter. The function of the filters 20, 21, 60, 61 corresponds to that of the filters shown in FIG. 3.

Figure 7:
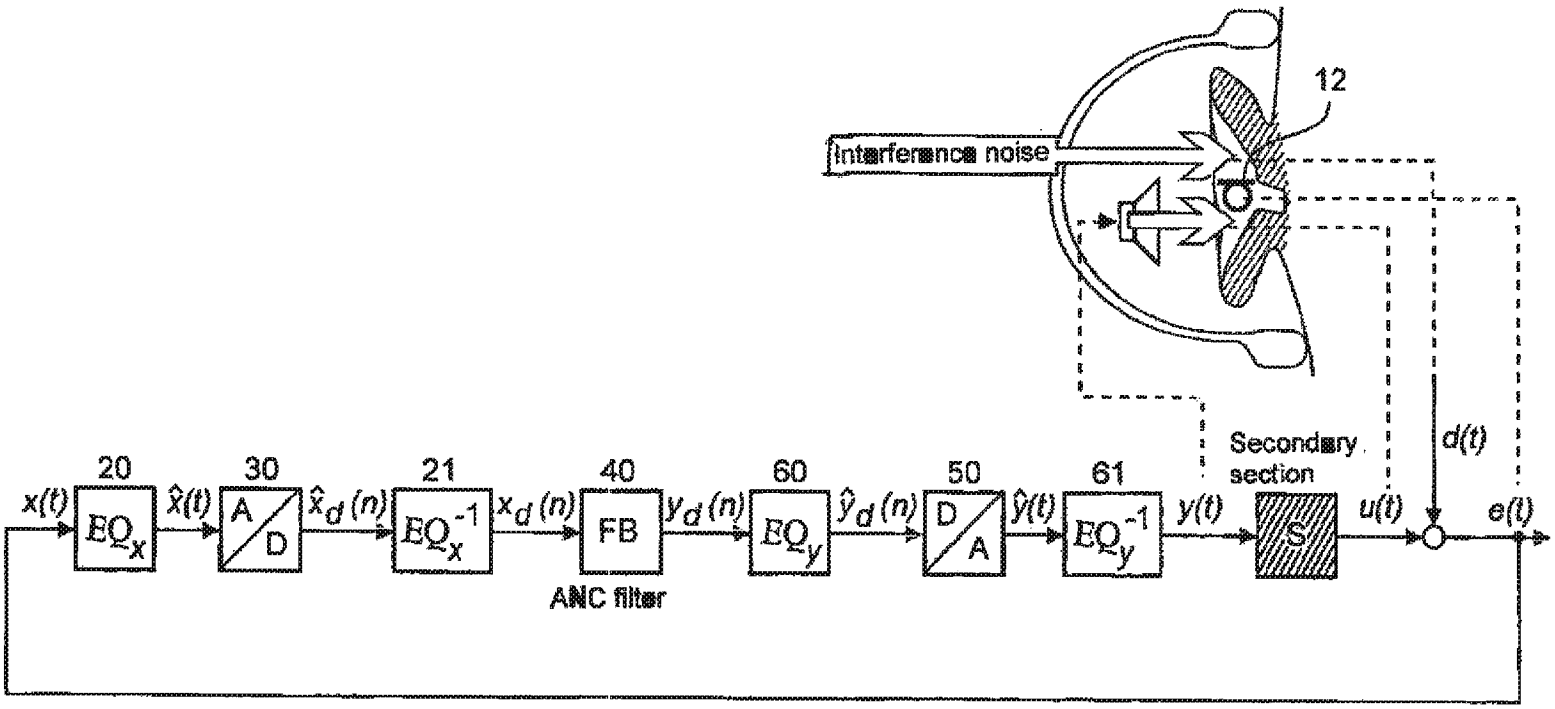
FIG. 7 shows a schematic block circuit diagram of an earphone or headset according to a sixth embodiment.

FIG. 7 shows a diagrammatic block circuit diagram of an earphone or headset according to a sixth embodiment. The earphone or headset of the sixth embodiment is based on the earphone or headset of the fourth embodiment, in addition with the equalization and compensation filters 20, 21, 60, 61 shown in FIG. 3, which are provided upstream and downstream of the AD-converter 30 and the DA-converter 50.

To determine the parameters of the filters 20, 21, 60, 61 it is advantageous if the maximum possible level $S_{max}$ (f) is ascertained by the external microphone 12 or the internal microphone 12 respectively. As an alternative thereto the maximum level can also be estimated.

The following then applies for the filter 20:

$$|EQ_x(f)| \approx \frac{1}{|S_{max}x(f)|}.$$

It can be concluded therefrom that 100% adaptation of the spectrum is not required but that limiting the signal dynamics can already lead to an adequate result. The following then applies for the filter 21 for digital compensation filtering:

$$EQ_x^{-1}(f) \approx \frac{1}{EQ_x(f)}.$$

Accordingly then the filter 61 in accordance with the fifth embodiment corresponds to:

$$|EQ_y(f)| \approx \frac{1}{|S_{max}x(f)| \cdot |FF|}.$$

It should then be possible to describe the compensation filter 61 as follows:

$$EQ_y^{-1}(f) \approx \frac{1}{EQ_y(f)}.$$

In the case of the sixth embodiment (feedback) which has an internal microphone 12, the filter 20 should then be described as follows:

$$|EQ_x(f)| \approx \left|\frac{1 - FB \cdot S}{S_{max}d(f)}\right|.$$

The filter 21 then corresponds to the inverse filter 20, that is to say:

$$EQ_x^{-1}(f) \approx \frac{1}{EQ_x(f)}.$$

The following then applies for the filter 60:

$$|EQ_y(f)| \approx \left|\frac{1 - FB \cdot S}{S_{max}d(f) \cdot FB}\right|.$$

The following then applies for the filter 61:

$$EQ_y^{-1}(f) \approx \frac{1}{EQ_y(f)}.$$

The filters 20, 60, 21, 61 according to the invention serve explicitly not for a filtering action at the edges of the frequency range to be processed, but relate to the frequency range to be processed and they permit an improvement in the signal-noise ratio. The transmission functions of the filters according to the invention are such that the maximum and minimum values in amplification differ from each other between 20 Hz and a quarter of the sampling frequency at at least 3 dB.

In a seventh embodiment of the invention which can be based on one of embodiments 1 through 6, there is provided an earphone or headset wherein the analog pre-emphasis filter 20 is in the form of an analog filter for performing noise compensation. The analog filter 20 according to the sixth embodiment is in the form of a static noise compensation system or filter. The active noise compensation unit 40 then only serves to adapt the required noise compensation, insofar as that is required. The digital range of the earphone, that is to say the active noise compensation unit 40, then has for example an amplification effect of 1 and only then adapts noise compensation when noise compensation can be improved.

The filter 20 of the sixth embodiment can be in the form of a pre-noise compensation unit. Here such a noise compensation unit performs static noise compensation if the output signal x (t) were to correspond to the output y (t). That can be achieved for example if the active noise compensation unit 40 does not become involved in active noise compensation. As an alternative thereto the active noise compensation unit 40 can be involved in noise compensation only if that would lead to improved noise compensation.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A earphone comprising:

at least one microphone configured to detect noise;

at least one analog pre-emphasis filter configured to pre-emphasize a microphone signal comprising noise;

an AD-converter configured to digitize the pre-emphasized output signal of the pre-emphasis filter;

an electro-acoustic reproduction transducer;

an active noise compensation unit configured to:

perform active noise compensation based on the pre-emphasized and digitized output signal of the AD-converter having the digitized noise; and output a counter sound signal to the electro-acoustic reproduction transducer; and a DA-converter configured to perform digital/analog conversion of the counter sound signal produced by the active noise compensation unit;

wherein filter parameters of the pre-emphasis filter are adapted to the maximum expected level of the audio signals detected by the microphone.

2. The earphone as set forth in claim 1, further comprising:

a digital pre-emphasis filter arranged between the active noise compensation unit and the DA-converter.

3. The earphone as set forth in claim 2;

wherein the analog pre-emphasis filter is in the form of a pre-noise compensation unit configured to perform static noise compensation.

4. The earphone as set forth in claim 1, further comprising:

a second analog pre-emphasis filter arranged downstream of the DA-converter.

5. The earphone as set forth in claim 4;

wherein the second analog pre-emphasis filter is in the form of a pre-noise compensation unit configured to perform static noise compensation.

6. The earphone as set forth in claim 1;

wherein the analog pre-emphasis filter is in the form of a pre-noise compensation unit configured to perform static noise compensation.

7. An earphone comprising:

at least one microphone configured to detect noise:

at least one analog pre-emphasis filter configured to pre-emphasize a microphone signal comprising noise;

an AD-converter configured to digitize the pre-emphasized output signal of the pre-emphasis filter;

an electro-acoustic reproduction transducer;

an active noise compensation unit configured to:

perform active noise compensation based on the pre-emphasized and digitized output signal of the AD-converter having the digitized noise; and output a counter sound signal to the electro-acoustic reproduction transducer;

a DA-converter configured to perform digital/analog conversion of the counter sound signal produced by the active noise compensation unit; and a digital pre-emphasis filter arranged between the active noise compensation unit and the DA-converter.

8. The earphone as set forth in claim 7;

wherein the analog pre-emphasis filter is in the form of a pre-noise compensation unit configured to perform static noise compensation.

9. An earphone comprising:

at least one microphone configured to detect noise:

at least one analog pre-emphasis filter configured to pre-emphasize a microphone signal comprising noise;

an AD-converter configured to digitize the pre-emphasized output signal of the per-emphasis filter;

electro-acoustic reproduction transducer;

an active noise compensation unit configured to:

perform active noise compensation based on the pre-emphasized and digitized output signal of the AD-converter having the digitized noise; and output a counter sound signal to the electro-acoustic reproduction transducer;

a DA-converter configured to perform digital/analog conversion of the counter sound signal produced by the active noise compensation unit; and a second analog pre-emphasis filter arranged downstream of the DA-converter.

10. The earphone as set forth in claim 9;

wherein the second analog pre-emphasis filter is in the form of a pre-noise compensation unit configured to perform static noise compensation.

11. A headset comprising:

at least one microphone configured to detect noise;

at least one analog pre-emphasis filter configured to pre-emphasize a microphone signal comprising noise;

an AD-converter configured to digitize the pre-emphasized output signal of the pre-emphasis filter;

an electro-acoustic reproduction transducer;

an active noise compensation unit configured to perform active noise compensation based on the pre-emphasized and digitized output signal of the AD-converter having the digitized noise; and output a counter sound signal to the electro-acoustic transducer; and a DA-converter for performing digital/analog conversion of the counter sound signal produced by the active noise compensation unit;

wherein filter parameters of the pre-emphasis filter are adapted to the maximum expected level of the audio signals detected by the microphone.

12. A method of controlling an earphone which has a microphone configured to detect noise, an active noise compensation unit, and an electro-acoustic reproduction transducer, comprising the steps:

pre-emphasizing an analog microphone signal comprising noise by an analog pre-emphasis filter;

digitizing the output signal of the pre-emphasis filter;

performing active noise compensation based on the pre-emphasized and digitized output signal of the microphone having the digitized noise and outputting a counter sound signal to the electro-acoustic reproduction transducer; and performing a digital/analog conversion of the counter sound signal produced by the active noise compensation unit;

wherein filter parameters of the pre-emphasis filter are adapted to the maximum expected level of the audio signals detected by the microphone.

* * * * *